US005253458A

United States Patent [19]

Christian

[11] Patent Number: 5,253,458

[45] Date of Patent: Oct. 19, 1993

[54] SIMULATED LOG AND PANEL PREFABRICATED HOUSE STRUCTURE

[76] Inventor: Dean Christian, 310 Dolph Rd., Mankato, Minn. 56001

[21] Appl. No.: 838,861

[22] Filed: Feb. 21, 1992

[51] Int. Cl.[5] ..... E04B 1/10

[52] U.S. Cl. ..... 52/233; 52/309.7; 52/223.7

[58] Field of Search ..... 52/233, 227, 309.7

[56] References Cited

U.S. PATENT DOCUMENTS

| | | | |
|---|---|---|---|
| 2,130,231 | 9/1938 | Forciea | 52/233 |
| 3,189,950 | 6/1965 | Johnson | 52/233 |
| 3,810,337 | 5/1974 | Pollard | 52/309.7 |
| 3,992,838 | 11/1976 | Vizziello | 52/233 |
| 4,305,238 | 12/1981 | Harward et al. | 52/233 |
| 4,433,519 | 2/1984 | Jenkins | 52/233 |
| 4,503,648 | 3/1985 | Mahaffey | 52/227 |
| 4,688,362 | 8/1987 | Pedersen et al. | 52/233 |
| 4,823,528 | 4/1989 | Faw | 52/233 |
| 5,020,289 | 6/1991 | Wrightman | 52/233 |

FOREIGN PATENT DOCUMENTS

| | | | |
|---|---|---|---|
| 685620 | 5/1964 | Canada | 52/227 |
| 1295172 | 5/1969 | Fed. Rep. of Germany | 52/309.7 |
| 2250611 | 4/1973 | Fed. Rep. of Germany | 52/309.7 |
| 1345722 | 11/1963 | France | 52/233 |
| 1439058 | 4/1966 | France | 52/233 |

*Primary Examiner*—Carl D. Friedman
*Assistant Examiner*—Joanne C. Downs
*Attorney, Agent, or Firm*—S. Michael Bender

[57] ABSTRACT

Simulated logs for home construction are formed from PVC pipe which is filled with hard cast foam. The pipes are precast with a simulated log design to include knots, cracks and wood grain, and the bottom of each log contains a one inch groove to hold a longitudinally extending rubber gasket. The logs are attached together by threaded rod fasteners which utilize doubleended nuts, and caps are used to close off the ends of the log. Plumbing, electrical conduits, and the like may be retained within the tubing, and T-bolts are used to attach the initial log to a concrete foundation. The PVC pipe can be either of a round or square cross sectional shape and, in addition to log shapes, the PVC tubing can also be formed into rectangularly-shaped blocks similar to bricks and concrete blocks now used in the construction trade.

1 Claim, 4 Drawing Sheets

SIMULATED LOG AND PANEL PREFABRICATED HOUSE STRUCTURE

BACKGROUND OF THE INVENTION

1. Field of the Invention

The present invention relates to log homes and more particularly pertains to simulated logs for homes constructed from a plastic material.

2. Description of the Prior Art

The use of simulated log siding is known in the prior art. A typical example of simulated log siding is shown in U.S. Pat. No. 4,288,954 which issued to R. O'Donnell on Sep. 15, 1981. The log appearance in this patent is created through the use of colored cement-plaster formed over a wire metal lath shaped to be generally semicircular so as to give the appearance of a log. Another typical example of a prior art simulated log building structure is shown in U.S. Pat. No. 4,777,773 which issued to A. Fry on Oct. 18, 1988. This simulated structure is formed from plastic tubing, and the tubing is all structured to facilitate the flow of a fluid medium through the walls for the purposes of heating or cooling.

Both of these patents are representative of a far larger number of patents which could have been provided and which relate to simulated log structures. As can be appreciated, the nature of the art is such that there is always room for improvement whereby a more efficient manner of attaching and interconnecting such simulated logs can be accomplished, and in this respect, the present invention substantially addresses this need.

SUMMARY OF THE INVENTION

In view of the foregoing disadvantages inherent in the known types of simulated log building structures now present in the prior art, the present invention provides an improved simulated log construction wherein the logs are more efficiently attached together while giving a much more realistic appearance of a real log building structure. As such, the general purpose of the present invention, which will be described subsequently in greater detail, is to provide a new and improved simulated log building structure which has all the advantages of the prior art simulated log building structures and none of the disadvantages.

To attain this, the present invention essentially comprises simulated logs for home construction which are formed from PVC pipe filled with hard cast foam. The pipes are precast with a simulated log design to include knots, cracks and wood grain, and the bottom of each log contains a one inch groove to hold a longitudinally extending rubber gasket. The logs are attached together by threaded rod fasteners which utilize doubleended nuts, and caps are used to close off the ends of the log. Plumbing, electrical conduits, and the like may be retained within the tubing, and T-bolts are used to attach the initial log to a concrete foundation. The PVC pipe can be either of a round or square cross sectional shape and, in addition to log shapes, the PVC tubing can also be formed into rectangularly-shaped blocks similar to bricks and concrete blocks now used in the construction trade.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved simulated log building structure which has all the advantages of the prior art simulated log building structures and none of the disadvantages.

It is another object of the present invention to provide a new and improved simulated log building structure which may be easily and efficiently manufactured and marketed.

It is a further object of the present invention to provide a new and improved simulated log building structure which is of a durable and reliable construction.

An even further object of the present invention is to provide a new and improved simulated log building structure which is susceptible of a low cost of manufacture with regard to both materials and labor, and which accordingly is then susceptible of low prices of sale to the consuming public, thereby making such simulated log building structures economically available to the buying public.

Still yet another object of the present invention is to provide a new and improved simulated log building structure which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
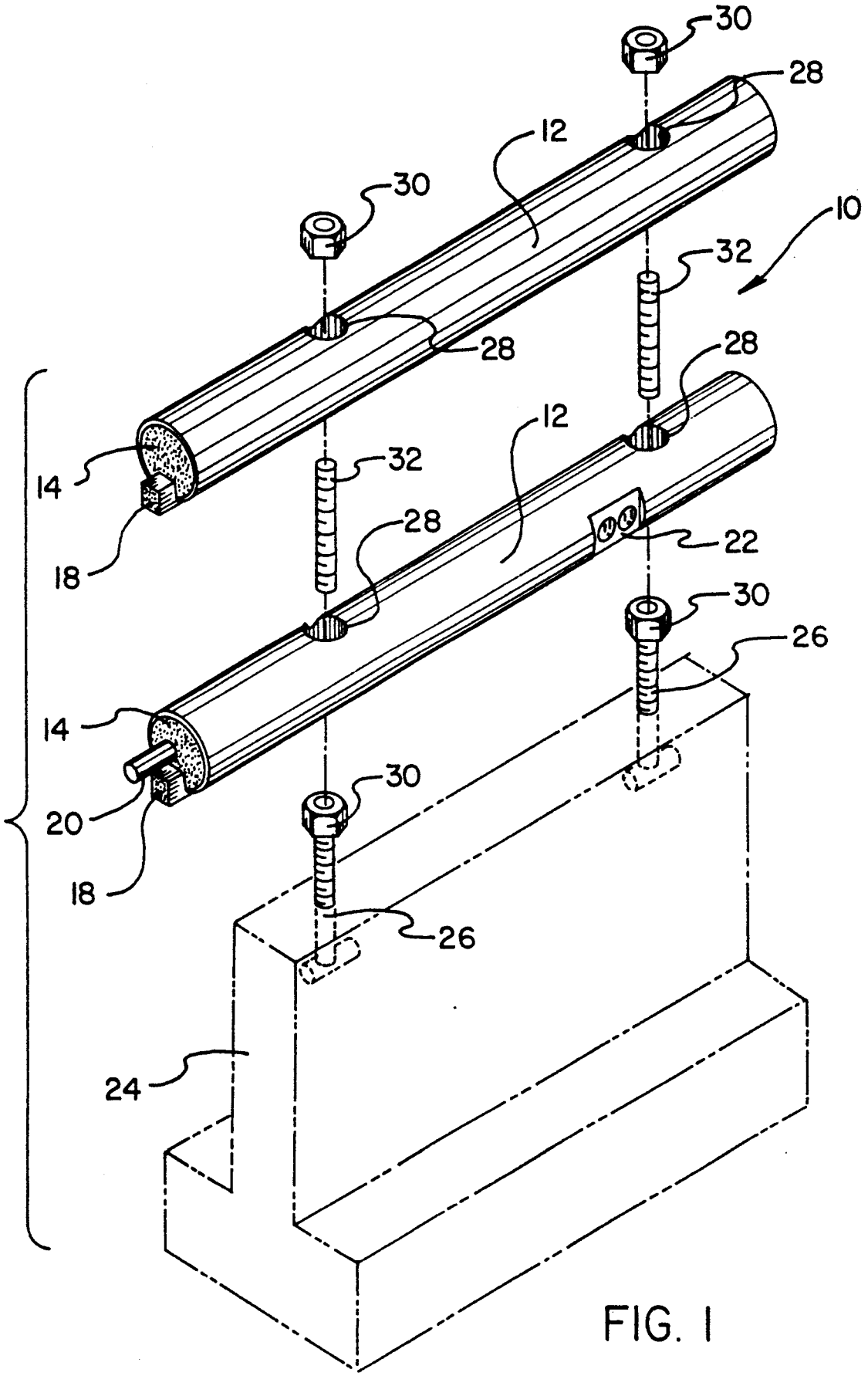
FIG. 1 is an exploded perspective view illustrating a preferred manner of connecting together the log members comprising the present invention.

With reference now to the drawings, and in particular to FIG. 1 thereof, a new and improved simulated log building structure embodying the principles and concepts of the present invention and generally designated by the reference numeral 10 will be described.

More specifically, it will be noted that the basic component of the invention 10 comprises sections of polyvinyl chloride (PVC) tubing 12 which may be precast with a simulated external log design to include knots, cracks, and wood grain, and which may then be selectively filled with a hard foam insulation 14 wherein such installation could be dilite or bead type foam. Each section of PVC tubing 12 can be cast with a bottommost longitudinally extending groove 16 into which a continuous rubber seal 18 may be inserted. The seal 18 is compressible between two sections of PVC tubing 12 so as to form an airtight barrier at the time of assembly.

As further illustrated in FIG. 1, a sidewall structure formed from a plurality of lengths of PVC tubing 12 may include one or more tubing sections having electrical conduit 20 already mounted within the hard foam insulation 14. This, of course, facilitates electrical wiring at the time of construction, and a section of tubing 12 may even be cast with an electrical outlet 22 formed therein.

As to the basic manner of assembly of the sidewall structure, FIG. 1 illustrates a typical concrete foundation 24 into which a plurality of upstanding T-bolts 26 are cast. An initial section of PVC tubing is mounted over the T-bolts through preformed, through-extending apertures 28 formed in each section of tubing. Elongated double nuts 30 are positionable in a countersunk portion of the apertures 28, and a plurality of short individual threaded rods 32 can be connected along with a plurality of the nuts 30 to effectively allow selective assembly of a wall structure of any height. More specifically, each nut 30, once attached to the top of a threaded rod 32, operates to hold a certain section of PVC tubing 12 in position and another threaded rod may be then attached to a top portion of a double nut at the time of attachment of even a further section of tubing.

Figure 2:
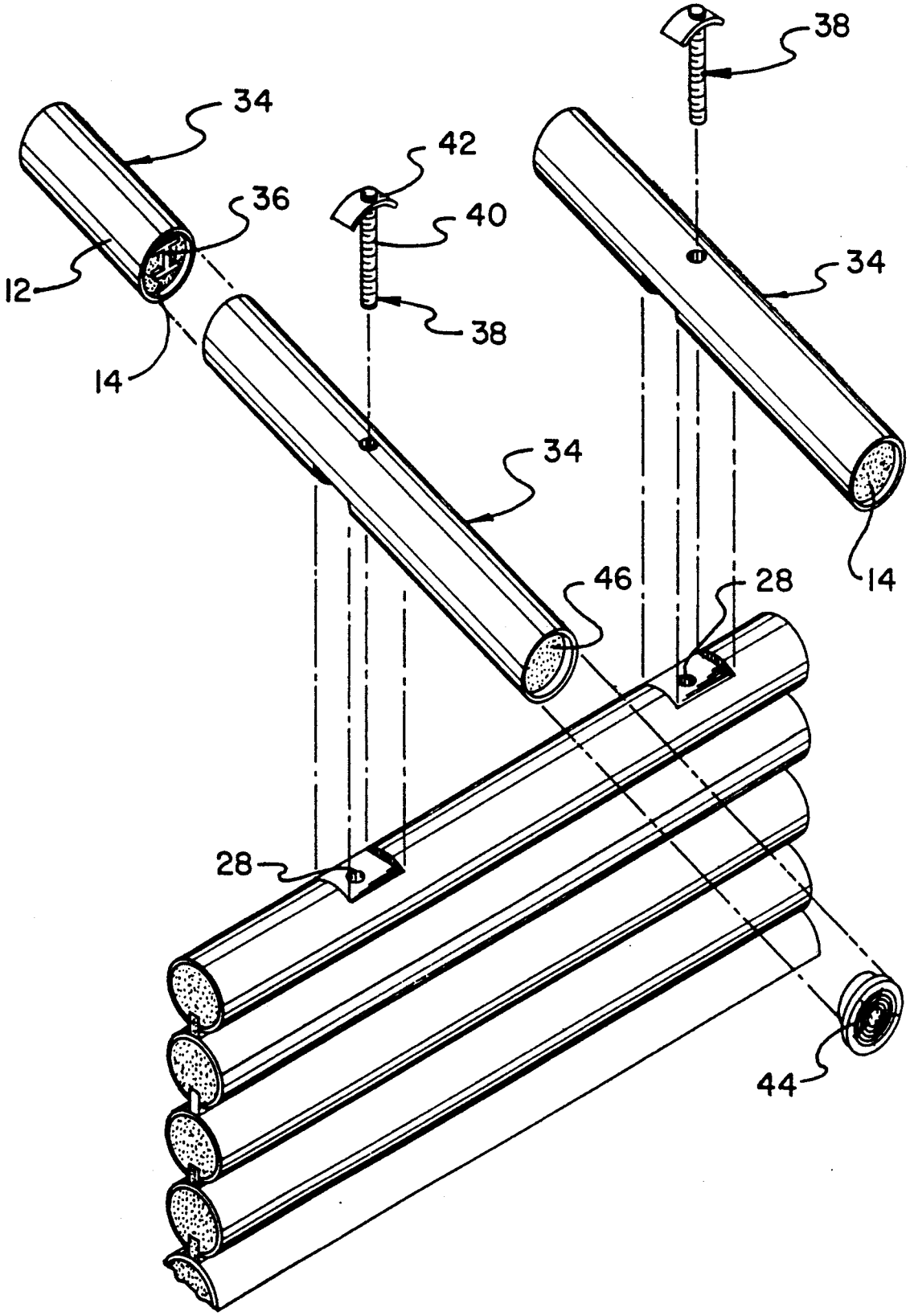
FIG. 2 is an exploded perspective view illustrating further features of the present invention.

FIG. 2 illustrates further components of the log structure forming a part of the invention. In this regard, sidewall and roof support beams 34 may be constructed from a section of PVC tubing 12 having an inner core of hard foam insulation 14 which is formed around a steel eye beam 36 extending along the total length of the tubing section 34. This provides the substantial strength required to perform the load bearing functions of the structure.

Threaded strap members 38 are formed from a threaded rod 40 and a curved holding member 42 fixedly secured to a top portion thereof. The threaded rod 40 is attachable to the aforedescribed double nuts retained within a countersunk aperture 28 and, in the case of a roof truss, steel reinforced tubing 34 would be utilized. To complete the appearance of the roof trusses, premolded wood grain end caps 44 are positionable within an end opening 46 of each exposed tubing member 34.

Figure 3:
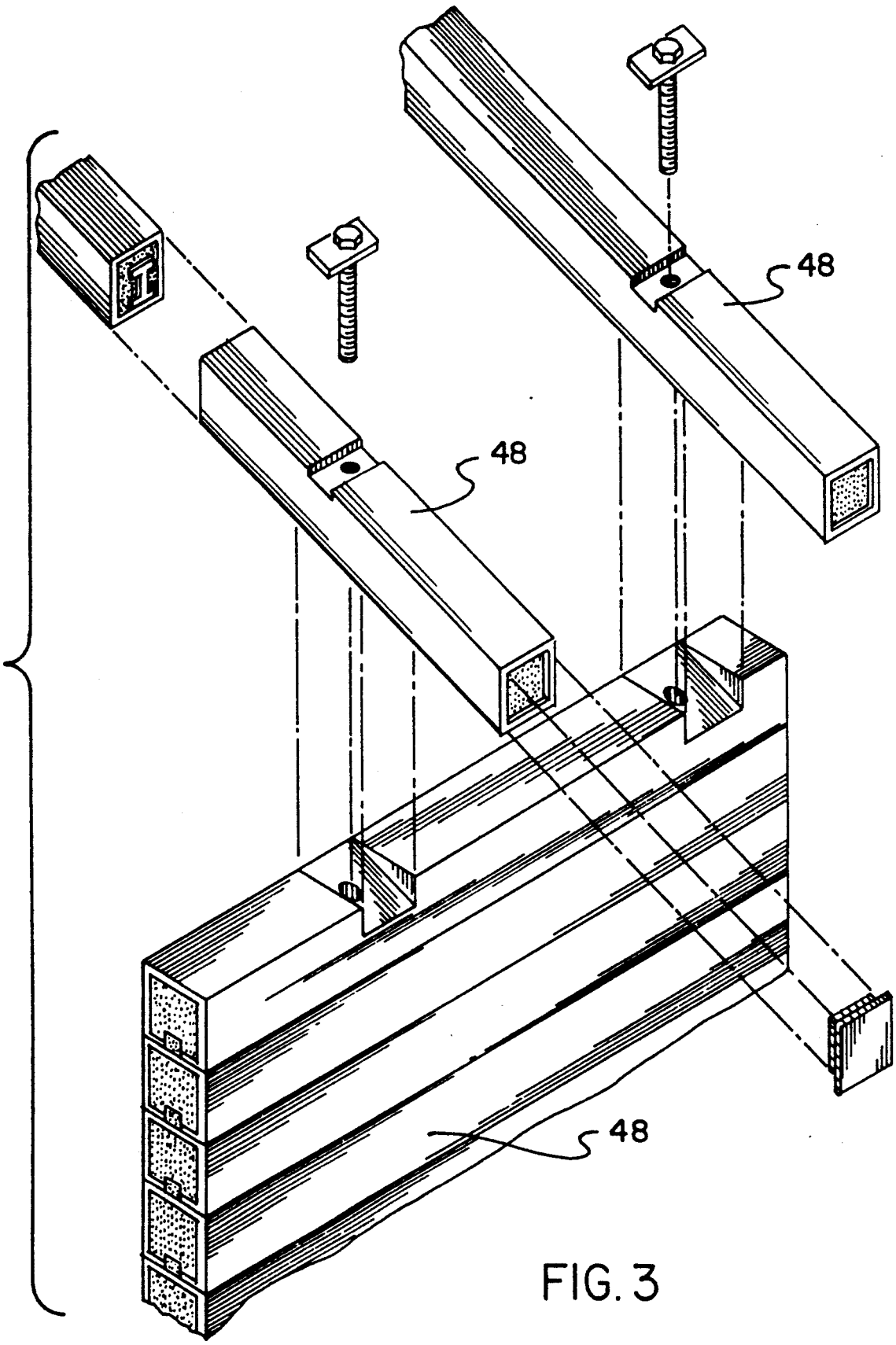
FIG. 3 is an exploded perspective view illustrating the use of square shaped log members.
Figure 4:
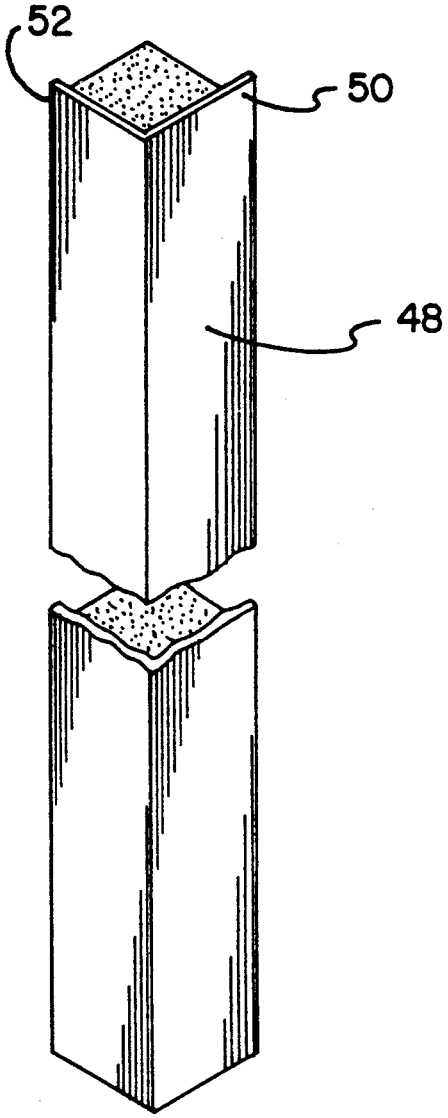
FIG. 4 is a perspective view of a square shaped log member.
Figure 5:
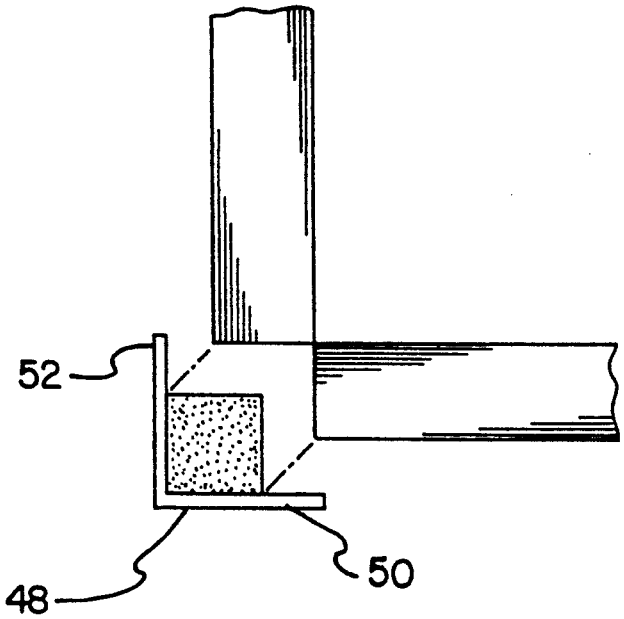
FIG. 5 is a top plan view illustrating a use of the log member shown in FIG. 4.
Figure 6:
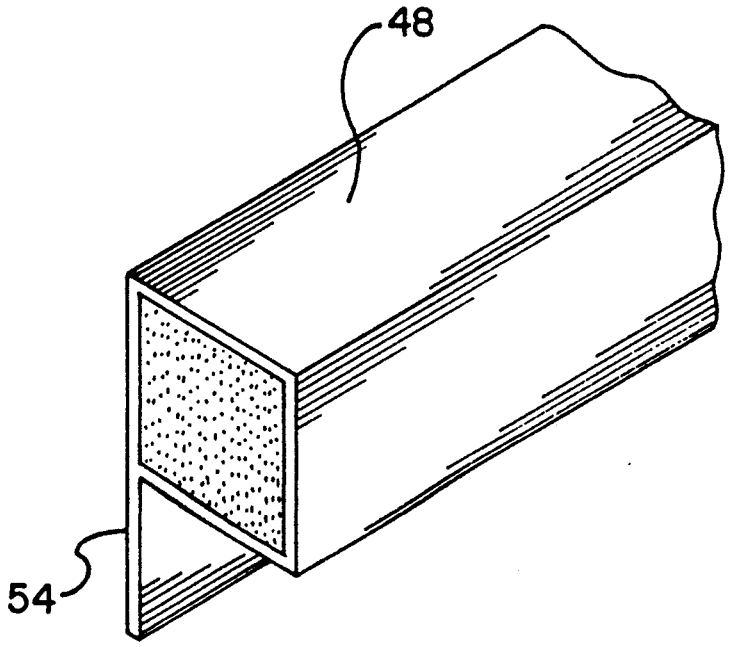
FIG. 6 is a perspective view of a modified embodiment of a square shaped log member.

FIG. 3 is essentially the same structure shown in FIG. 2 with the exception that square-shaped log members 48 are used in place of the tubular-shaped log members 34. As shown in FIGS. 4 and 5, a square-shaped log member 48 may have outwardly extending edges 50, 52, thereby to define a more secure corner structure. Additionally, as shown in FIG. 6, a square-shaped log member 48 may include only a single integral flanged edge 54 which facilitates an overlapping construction of the log members in a now apparent manner. Additionally, a log member 48 may be constructed of any length so as to permit its use as a brick or block as opposed to just a log.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

As to the manner of usage and operation of the present invention, the same should be apparent from the above description. Accordingly, no further discussion relating to the manner of usage and operation will be provided.

What is claimed as being new and desired to be protected by Letters Patent of the United States is as follows:

1. A simulated log structure comprising:

at least one hollow plastic tube having an external simulated wood grain surface;

an insulation core positionable within said tube;

an electrical conduit positionable within said insulation core and at least one electrical outlet in the side of said hollow tube connected to said electrical conduit, a horizontally extending groove molded along a complete axial length of said tube;

a rubber seal retained within said groove, thereby to provide a sealing function between a pair of said tubes when said tubes are juxtaposed together a steel reinforcing rod member positionable within said insulation core, said simulated log structure further comprising a plurality of cross-extending through-directed apertures for facilitating an interconnection of a plurality of said plastic tubes.

said simulated log structure further including threaded fastening rods positionable within said cross-extending apertures, said rods adapted to be connectable together through a use of double ended nuts and T-bolts adapted to be selectively positionable within a concrete foundation, said T-bolts forming an initial connection of said plastic tubes in said structure, said simulated log structure further including at least one additional hollow plastic tube having an external simulated wood grain surface to serve as a roof truss, said roof truss hollow plastic tube having an insulation core positionable therein and a steel reinforcing rod member positionable within said insulation core, and an end cap adapted to be affixed to said roof truss hollow plastic tube, said end cap having a simulated wood grain surface appearance.

* * * * *